US009095858B2

(12) United States Patent
Fukanuma

(10) Patent No.: US 9,095,858 B2
(45) Date of Patent: Aug. 4, 2015

(54) COLD-SPRAY NOZZLE AND COLD-SPRAY DEVICE USING COLD-SPRAY NOZZLE

(75) Inventor: Hirotaka Fukanuma, Tokyo (JP)

(73) Assignee: Plasma Giken Co., Ltd., Tokyo (JP)

( * ) Notice: Subject to any disclaimer, the term of this patent is extended or adjusted under 35 U.S.C. 154(b) by 90 days.

(21) Appl. No.: 13/996,159

(22) PCT Filed: Dec. 22, 2010

(86) PCT No.: PCT/JP2010/073206

§ 371 (c)(1),
(2), (4) Date: Aug. 28, 2013

(87) PCT Pub. No.: WO2012/086037

PCT Pub. Date: Jun. 28, 2012

(65) Prior Publication Data

US 2013/0327856 A1 Dec. 12, 2013

(51) Int. Cl.

| | |
|---|---|
| ***B05B 1/26*** | (2006.01) |
| ***B05B 7/14*** | (2006.01) |
| ***B05B 1/00*** | (2006.01) |
| ***B05B 1/02*** | (2006.01) |
| ***B05B 7/16*** | (2006.01) |
| ***B05B 7/04*** | (2006.01) |
| ***C23C 24/04*** | (2006.01) |

(52) U.S. Cl.

CPC ..... *B05B 7/1486* (2013.01); *B05B 1/00* (2013.01); *B05B 1/02* (2013.01); *B05B 7/04* (2013.01); *B05B 7/14* (2013.01); *B05B 7/16* (2013.01); *C23C 24/04* (2013.01); *Y10S 239/19* (2013.01)

(58) Field of Classification Search

CPC ..... B05B 7/1486; B05B 7/14; B05B 7/04; B05B 7/16; B05B 1/24; B05B 1/02; B05B 1/00; B05B 9/002; C23C 24/04; C23C 4/12; Y10S 239/19

USPC ..... 239/79, 128, 135, 398, 434.5, 589, 591, 239/601, DIG. 19

See application file for complete search history.

(56) References Cited

U.S. PATENT DOCUMENTS

| | | | | |
|---|---|---|---|---|
| 4,911,805 | A | 3/1990 | Ando et al. | |
| 7,143,967 | B2 * | 12/2006 | Heinrich et al. | 239/434.5 |
| 7,637,441 | B2 * | 12/2009 | Heinrich et al. | 239/135 |

FOREIGN PATENT DOCUMENTS

| | | | |
|---|---|---|---|
| JP | 2008093635 | A | 4/2008 |
| JP | 2008253889 | A | 10/2008 |
| JP | 2009179831 | A | 8/2009 |

* cited by examiner

*Primary Examiner* — Steven J Ganey
(74) *Attorney, Agent, or Firm* — The Webb Law Firm

(57) ABSTRACT

An object of the present invention is to provide a cold-spray nozzle that can be continuously used for a long time without causing clogging up of the nozzle compared to a conventional case to effectively obtain a high-quality film by a cold-spray method. To achieve the object, the cold-spray nozzle that is a convergent-divergent type cold-spray nozzle comprising a convergent part, a throat part, and a divergent part sequentially arranged in this order for constituting a working gas flow path along a working gas flow direction from an inlet side to an outlet side is employed. The inner peripheral surface of the divergent part has a conical shape and at least a part of the inner peripheral surface is constituted by a glass material.

4 Claims, 4 Drawing Sheets

COLD-SPRAY NOZZLE AND COLD-SPRAY DEVICE USING COLD-SPRAY NOZZLE

TECHNICAL FIELD

The present invention relates to a convergent-divergent type cold-spray nozzle that does not clog up even when film formation is carried out by a cold-spray method for a long time, and relates to a cold-spray device using the cold-spray nozzle.

BACKGROUND ART

Conventionally, an electroplating method, electroless plating method, sputtering deposition method, and plasma spraying method and the like have been adopted as a method for forming a film. However, a cold-spray method for forming a film using raw material powder in a solid phase has been paid attention as an alternative to the conventional methods for forming the film.

The cold-spray method is a method for forming a film including steps; putting raw material powder such as metal, alloy, intermetallic compounds, and ceramics into a supersonic gas flow heated; ejecting the raw material powder and the working gas together from a spout of a nozzle of a cold-spray gun; and crashing the raw material powder in a solid phase into a base material at high speed of 500 m/s to 1200 m/s.

The film formed by the cold-spray method is known as the film not easily oxidized nor thermally deteriorated as compared to a film formed by a conventional method. Further, the film formed by the cold-spray method is dense and excellent in adhesion, and is excellent in the film properties including electrical conductivity and thermal conductivity also.

However, the cold-spray method has drawback that raw material powder is clogged up in a nozzle in the cold-spray operation and it prevents the cold-spray method from being popular in the market. A cold-spray nozzle is usually made by using a metal material such as stainless steel, tool steel, and cemented carbide. When such a cold-spray nozzle made of metal is used in combination with a powder such as nickel powder, copper powder, aluminum powder, stainless steel powder, and "Inconel (Registered Trade Mark, the same hereinafter) alloy" powder as raw material powder, the raw material powder sticks on the inner peripheral surface of the cold-spray nozzle. Depending on the type of the raw material powder, the nozzle clogs up in a few minutes after starting of the cold-spray operation. Therefore, long time cold-spray operation has not been achieved. Such a phenomenon hinders the formation of a dense and uniform film. Same time, frequent exchange of the cold-spray nozzle may decrease the operation ratio of the cold-spray device and increase the cost for the film formation. To solve such problems, the following invention has been proposed.

Patent Document 1 discloses an object of the invention to drastically prevent both the sticking of the raw material powder to the divergent part of the nozzle and the clogging up of the cold-spray nozzle. Then, the measure disclosed is characterized in that a cold-spray nozzle that includes a convergent part and a divergent part; raw material powder is put into the convergent part from an inlet using working gas at a temperature equal to or below the melting point of the raw material powder; and eject the raw material powder from an spout of a nozzle at an outlet of the divergent part as a supersonic flow; wherein the divergent part, at least its inner peripheral surface is formed of materials including silicon nitride ceramics (N-based ceramics), zirconia ceramics (O-based ceramics), and silicon carbide ceramics (C-based ceramics), hereinafter collectively referred to as "OCN-based ceramics" is employed.

According to Examples disclosed in Patent Document 1, when copper powder is used as raw material powder and a cold-spray nozzle made of stainless steel is used, the cold-spray nozzle clogs up in approximately three to four minutes after starting of the cold-spray operation and it makes the cold-spray operation impossible. In contrast, when a cold-spray nozzle made of OCN-based ceramics was used, the phenomenon, sticking of copper powder to the inner peripheral surface of the cold-spray nozzle hardly occurs and the nozzle does not clog up even 30 minutes after starting of the cold-spray operation. Therefore, the invention disclosed in Patent Document 1 may effective to prevent the clogging up of the cold-spray nozzle.

DOCUMENTS CITED

Patent Documents

[Patent Document 1] Japanese Patent Laid-Open No. 2008-253889

SUMMARY OF THE INVENTION

Problems to be Solved

However, technical fields that require application of a high-quality film formed by the cold-spray method have been grown in the market. As a result, the market has been demanded a cold-spray nozzle that can be continuously used further long time to achieve the high productivity.

Further, the technical fields intending to form a thick film, not a thin film by the cold-spray method also exists. For example, the demand includes forming of a thick copper layer having the thickness exceeding 10 mm by the cold-spray method using a copper powder as a raw material powder. In such case, the continuous cold-spray operation for 100 minutes or more is required. In such continuous operation for a long time, the copper powder sticks to the inner peripheral surface of the cold-spray nozzle and the raw material powder deposits at the stuck portion even when the cold-spray nozzle made of OCN-based ceramics disclosed in Patent Document 1 is used, i.e. the nozzle clogs up not to enable a further film formation.

Therefore, an object of the present invention is to provide a cold-spray nozzle that can be continuously used for a long time without clogging up of the cold-spray nozzle even when raw material powder that more easily cause the clogging up of the nozzle than the copper powder is used.

Means to Solve the Problem

As a result of diligent study, the present inventors arrived at the following invention as a solution of the above-described problem. The present invention will be explained below.

Cold-Spray Nozzle According to the Present Invention:

A cold-spray nozzle according to the present invention is a convergent-divergent type nozzle comprising a convergent part, a throat part, and a divergent part sequentially arranged in this order for constituting an working gas flow path along a working gas flow direction from an inlet side to an outlet side, characterized in that an inner peripheral surface of the divergent part has a conical shape and a part of or the entire inner peripheral surface is constituted by a glass material.

In the cold-spray nozzle according to the present invention, a part of the inner peripheral surface constituted by the glass material in the divergent part may be the area from the position within 50 mm from the throat part toward the outlet side of the working gas to the spout from where the working gas ejects.

In the cold-spray nozzle according to the present invention, the glass material is preferable to be quartz glass or borosilicate glass.

Cold-Spray Device According to the Present Invention:

A cold-spray device according to the present invention is characterized in that comprising the cold-spray nozzle described above.

Advantages of the Invention

In the cold-spray nozzle according to the present invention, at least a part of the inner peripheral surface of the divergent part where raw material powder easily sticks is constituted by a glass material. By using the present cold-spray nozzle, the raw material powder does not stick to the inner peripheral surface of the cold-spray nozzle even when the cold-spray operation is continued for a long time. A cold-spray film of stable quality can be obtained in a long time operation.

Figure 1:
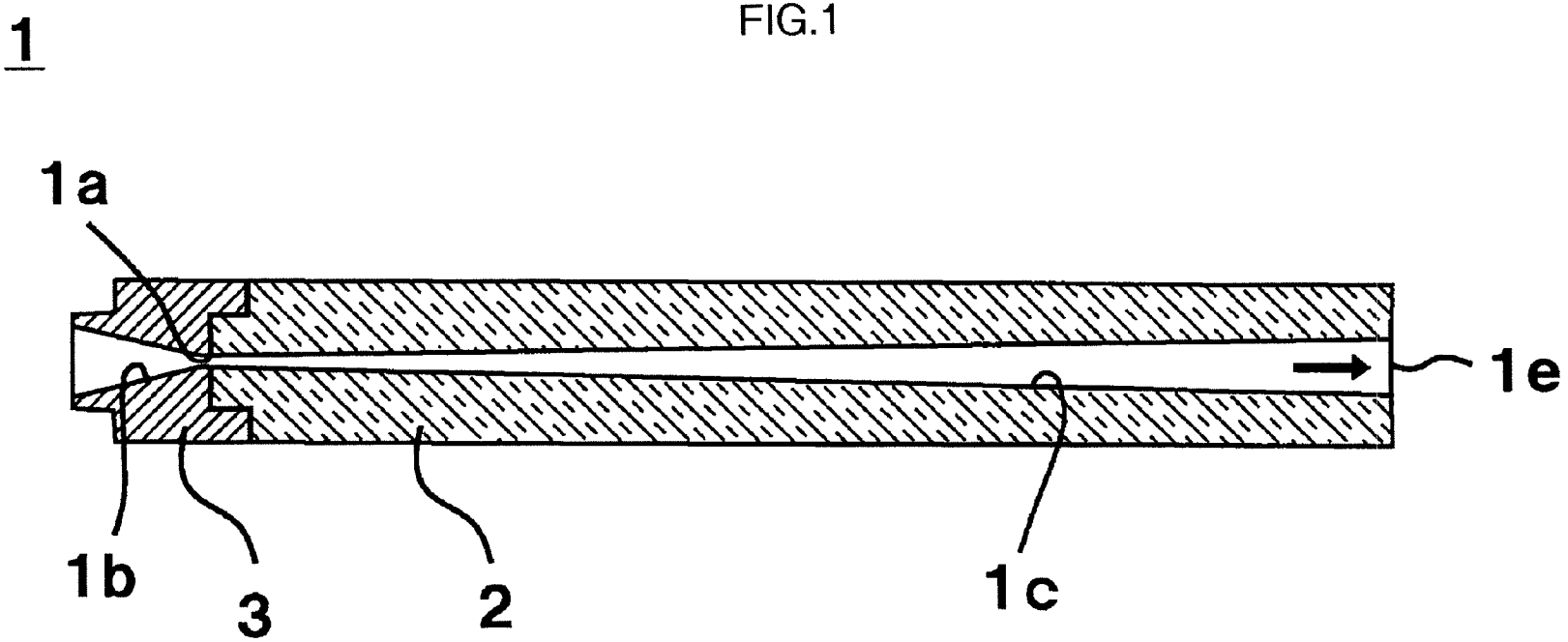
FIG. 1 is a schematic cross-sectional view showing an example of a cold-spray nozzle according to the present invention.

Reference symbols used in the drawings above will be explained. 1: cold-spray nozzle, 1*a*: throat part, 1*b*: convergent part, 1*c*: divergent part, 1*e*: spout, 2: glass material, 3: member made of material other than the glass material, 4: compressed gas cylinder, 5: working gas line, 6: carrier gas line, 7*a*, 7*b*: pressure regulator, 8*a*, 8*b*: flow regulating valve, 9*a*, 9*b*: flow-meter, 10*a*, 10*b*: pressure gauge, 11: cold-spray gun, 11*a*: powder port, 12: chamber, 13: manometer, 14: thermometer, 15: raw material powder supply device, 16: weighing machine, 17: raw material powder supply line, 18: heater power source, 19: working gas heater, 20: base material

DETAILED DESCRIPTION OF THE EMBODIMENTS

Figure 2:
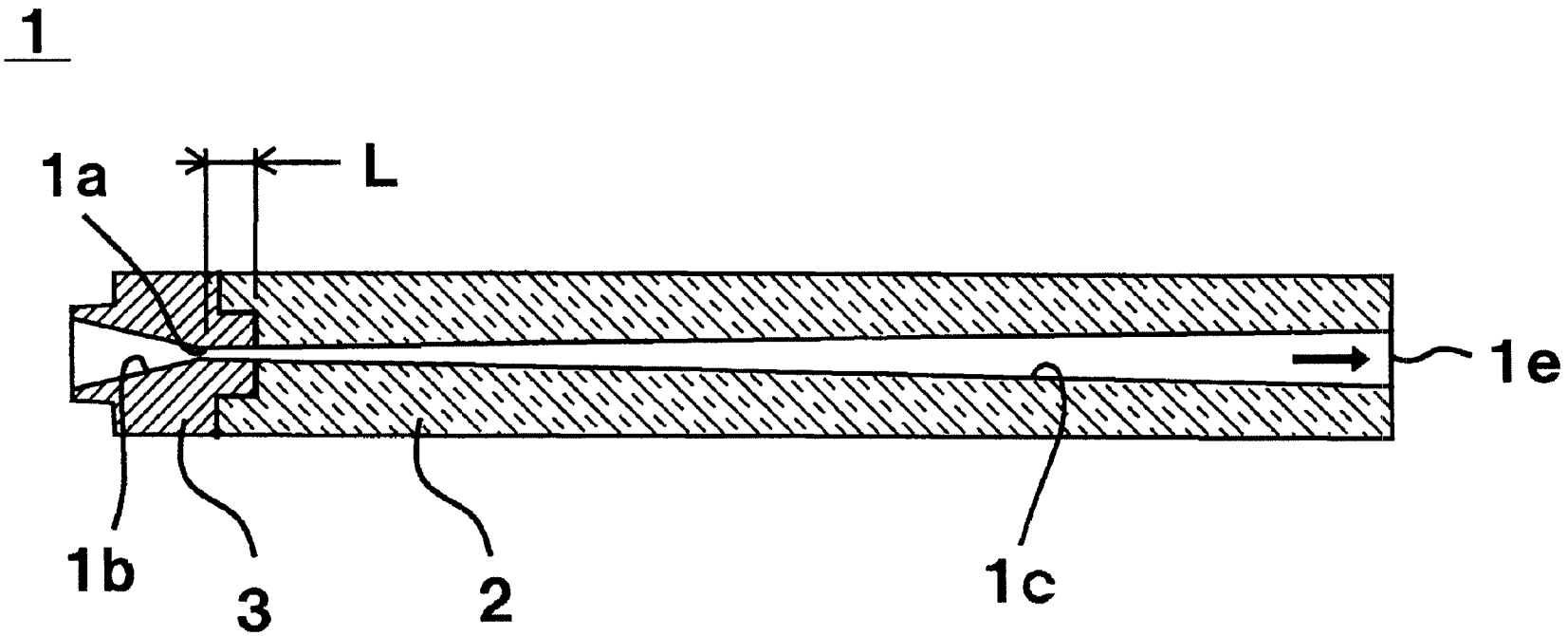
FIG. 2 is a schematic cross-sectional view showing an example of a cold-spray nozzle according to the present invention.
Figure 3:
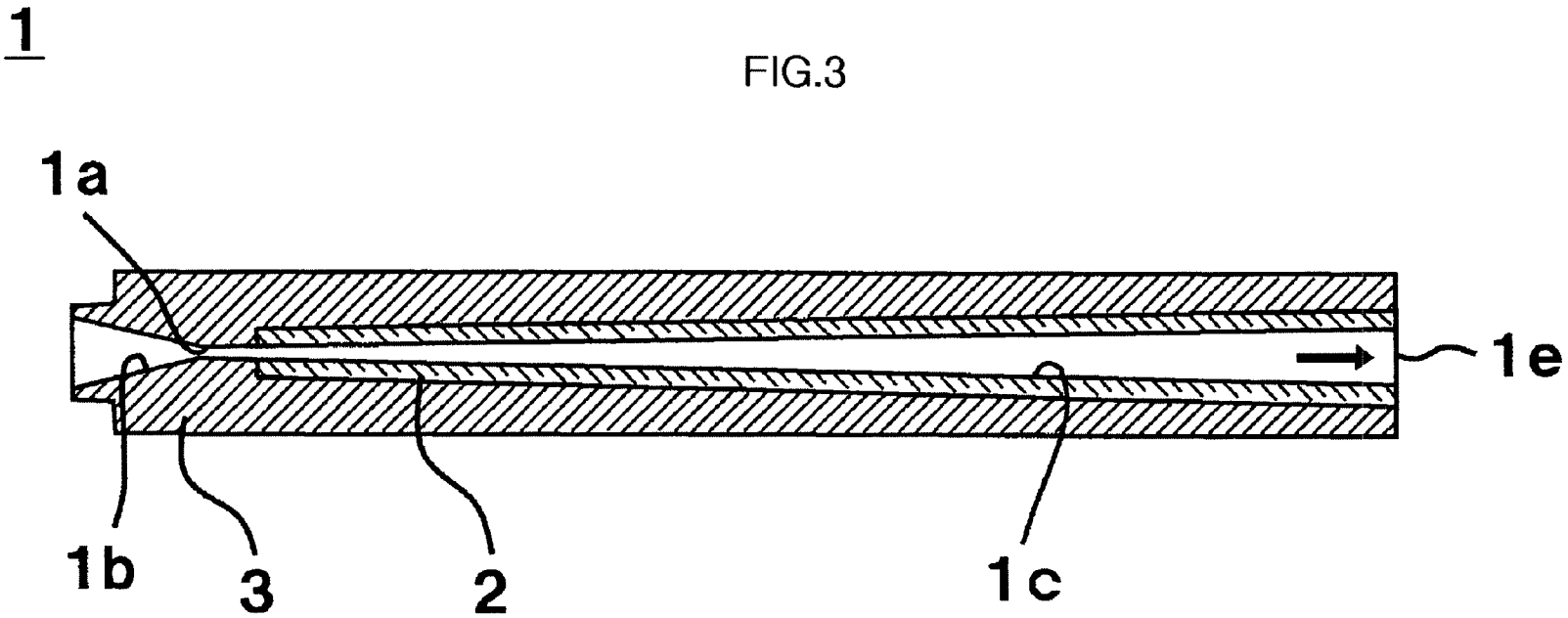
FIG. 3 is a schematic cross-sectional view showing an example of a cold-spray nozzle according to the present invention.
Figure 4:
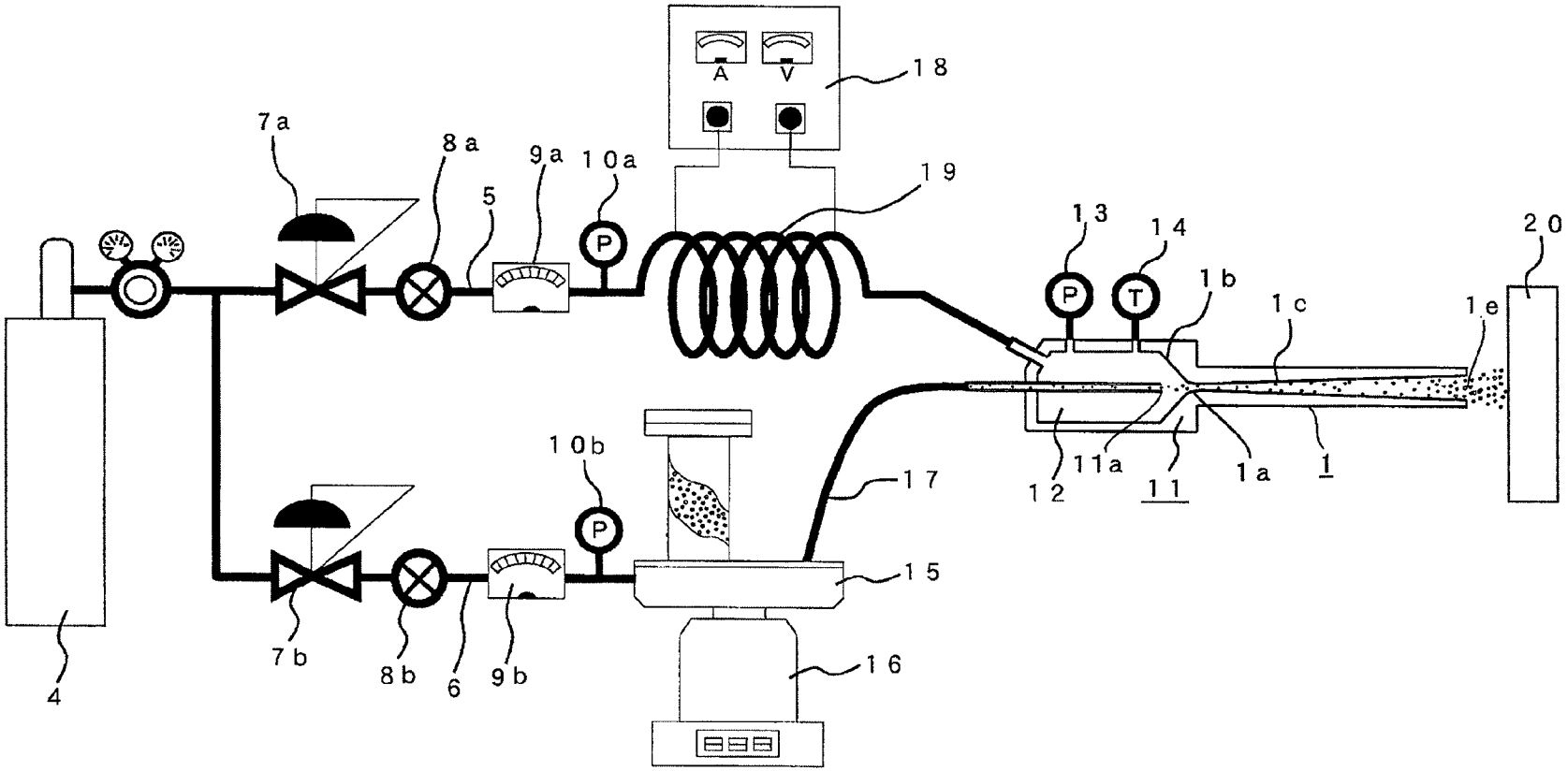
FIG. 4 is a schematic view showing an entire structure of a cold-spray device.

Embodiments of the present invention will be explained below with reference to the drawings. FIGS. 1 to 3 are schematic cross-sectional views exemplifying an embodiment of cold-spray nozzle according to the present invention. FIG. 4 is a schematic view showing an entire structure of a cold-spray device. So, the case where the cold-spray nozzle exemplified in FIG. 1 is equipped in the cold-spray device shown in FIG. 4 will be explained.

Embodiments of the Cold-Spray Nozzle According to the Present Invention:

The cold-spray nozzle according to the present invention is the cold-spray nozzle 1 comprising the convergent part 1*b*, the throat part 1*a*, and the divergent part 1*c* sequentially arranged in this order for constituting a working gas flow path along the working gas flow direction from an inlet side to an outlet side characterized in that the divergent part 1*c* has a conical space surrounded by its inner peripheral surface and a part of or the entire inner peripheral surface is constituted by glass material. Embodiments of the cold-spray nozzle 1 are shown in FIGS. 1 and 2. In the embodiments, the linear velocity of the working gas flow is slow in the convergent part 1*b*, and the flow from the convergent part 1*b* toward the throat part 1*a* is made to sonic velocity, and the maximum linear velocity is achieved at the spout of the divergent part 1*c* after passing the throat part 1*a*.

As shown in FIG. 3, in the cold-spray nozzle according to the present invention, a part of the inner peripheral surface constituted by the glass material in the divergent part may be the area from the position within 50 mm from the throat part toward the outlet side of the working gas to the spout from where the working gas ejects. That is, feature of the present invention is that the portion of the inner peripheral surface of the divergent part to where particles do not easily stick is not required to be constituted by a glass material.

The portion of the inner peripheral surface of the divergent part where particles do not easily stick is in the range of approximately 50 mm from the throat part toward the outlet side of the working gas in the divergent part. Within the range, a critical position where particles start to stick tends to be determined depending on the type of the particles, the linear velocity and the temperature of the particles. Therefore, the position for providing the glass material for the inner peripheral surface of the divergent part can be arbitrarily decided in view of the type of raw metal powder to be used and the operation condition of the cold-spray device and the like. Empirically, when the type of raw material powder is the same, particles tend to stick at the position of the divergent part 1*c* closer to the throat part 1*a* in the cold-spray nozzle 1 at a faster linear velocity of working gas and a higher temperature of the working gas. On the other hand, at a slower linear velocity of working gas and a lower temperature of the working gas, particles tend to stick to the outlet side of the divergent part 1*c* in the cold-spray nozzle 1.

The glass material 2 constituting the inner peripheral surface of the divergent part 1*c* according to the present invention will be described below. The glass material to be used in the present invention may include quartz glass, silica glass, alkaline silicate glass, soda lime glass, potash lime glass, lead glass, or barium glass. In the cold-spray nozzle 1 according to the present invention, the glass material 2 constituting the inner peripheral surface of the divergent part 1*c* can be appropriately selected depending on required characteristics including abrasion resistance and heat resistance required according to the condition including the type of raw material powder and the temperature of working gas. For example, when the raw material powder accompanying the working gas is metal powder of high hardness, hard glass employed as the glass material 2 constituting the inner peripheral surface of the divergent part 1*c* may reduces the abrasion and damage on the glass material constituting the inner peripheral surface. Further, when metal powder having high melting point is used as the raw material powder, heat-resistant glass employed as the glass material 2 constituting the inner peripheral surface of the divergent part 1*c* makes application of the temperature for the working gas exceeding 1000° C. easy.

Next, it is preferable to use either one of quartz glass and borosilicate glass as the glass material. It is because that the quartz glass and borosilicate glass are excellent in heat resistance and/or heat radiation. Further, the quartz glass and borosilicate glass have low coefficient of thermal expansion and excellent in thermal shock (rapid temperature difference) resistance. The quartz glass and borosilicate glass are also excellent in mechanical characteristics such as abrasion resistance, corrosion resistance, and tensile strength. Therefore, when the portion of the inner peripheral surface of the divergent part 1*c* where particles easily stick is constituted by either one of quartz glass and borosilicate glass, the sticking of raw material powder is effectively prevented and the clogging up of the nozzle is also prevented.

The entire structure of the cold-spray nozzle will be explained below. The configurations shown in FIGS. 1 to 3 are schematic cross-sectional views showing typical configurations of the cold-spray nozzle according to the present invention. All cold-spray nozzles 1 shown in FIGS. 1 to 3 are common in constituted by the members made of two materials, the glass material 2 and the member made of material other than the glass material 3. However, in FIGS. 1 and 2, almost all parts constituting the divergent parts 1*c* of the cold-spray nozzle are constituted by the glass material 2. In contrast, in FIG. 3, the cold-spray nozzle 1 is different in configuration that only a part of the inner peripheral surface of the divergent part 1*c* is constituted by the glass material.

The reason why the cold-spray nozzles shown in FIGS. 1 to 3 are employed will be explained. Of course, the convergent part and the throat part in the cold-spray nozzle can be constituted by glass material also. However, when the throat part is formed of the glass material, it is empirically known that the throat part abrades in a short time after starting of the cold-spray operation and the throat diameter increases. When the cross-sectional area of the throat part is indicated by [As] and the cross-sectional area of the divergent part is indicated by [Ad], the linear velocity of working gas is proportional to [Ad]/[As]. Therefore, when the throat diameter increases, i.e. [As] increases, the value of [Ad]/[As] decreases to make the linear velocity of the gas in the divergent part extremely slow and it makes deposition of a film impossible. So, it is not preferable. Thus, the throat part constituted by glass material is not preferable from the viewpoint of prevention of the throat diameter increase. Further, because it is also empirically known that particles may not easily stick to the portions including the convergent part and the throat part in the cold-spray nozzle, it is less necessary to use the glass material. Therefore, it is preferable that metal material or ceramic material that is excellent in abrasion resistance is selectively used for the convergent part and the throat part.

In the nozzles for the cold-spray 1 shown in FIGS. 1 and 2, the main parts of the divergent parts 1*c* are integrally molded by the glass material 2, and arbitrary connection means such as a joint structure are used as a required structure for coupling the divergent parts 1*c* to the throat parts 1*a*. The configurations can be easily understood from the drawings. However, for the configuration shown in FIG. 3, the detailed explanation may be required to understand. Then, the configuration will be explained below with reference mainly to FIG. 3.

In the cold-spray nozzle 1 according to the present invention, the convergent part 1*b*, the throat part 1*a*, and the divergent part 1*c* are at least required to include. The condition of their shapes can be arbitrarily set except that the space surrounded by the inner peripheral surface of the divergent part 1*c* has a conical shape. Therefore, the outer shape of the cold-spray nozzle 1 according to the present invention is not limited to the shapes shown in FIGS. 1 to 3, and the outer shape can be appropriately changed depending on requirement for easy handling and the like.

The cold-spray nozzle 1 according to the present invention is a so-called convergent-divergent type nozzle. Therefore, the cross-sectional area of the inner peripheral surface of the convergent part 1*b* gradually reduces toward the throat part 1*a*. On the other hand, the cross-sectional area of the inner peripheral surface of the divergent part 1*c* gradually increases from the throat part 1*a* toward the other end of the nozzle (the spout 1*e* side). That is, the insides of the convergent part 1*b* and the divergent part 1*c* are substantially conical spaces. The tapered angles of these substantially conical spaces, the lengths and the like of the convergent part 1*b* and the divergent part 1*c*, and the cross-sectional area of the throat part 1*a* can be arbitrarily set as long as they do not hinder the function of the cold-spray gun 11.

FIG. 3 exemplifies the structure in which the divergent part 1*c* is formed by two members of the glass material 2 and the member made of material other than the glass material 3. As can be understood from FIG. 3, in the cold-spray nozzle 1 according to the present invention, a part of the inner peripheral surface of the divergent part 1*c* is constituted by the glass material 2. That is, the cold-spray nozzle 1 shown in FIG. 3 has the structure that only a portion of the inner peripheral surface of the divergent part 1*c* where particles easily stick is provided with the inner peripheral surface constituted by the glass material 2, and the outer peripheral portion of the divergent part 1*c* is constituted by the member made of material other than the glass material 3 different from the glass material 2. The "material other than the glass material" used for the outer peripheral portion of the divergent part 1*c* may include a metal material and heat-resistant resin material. When metal material or heat-resistant resin material is used for the outer peripheral portion of the divergent part 1*c*, the inner peripheral surface of the divergent part 1*c* made of the glass material is not easily damaged even if strong shock is loaded, i.e. the handling performance can be improved. Further, such a structure enables exchange of just the glass material 2 constituting the inner peripheral surface of the divergent part 1*c*. Therefore, even when the glass material for the inner peripheral surface is damaged, exchange of the entire cold-spray nozzle 1 is not required. Only the glass material 2 can be exchanged.

When the glass material is used in combination with the material other than the glass material, it is preferable that materials having close coefficients of linear expansion as much as possible are selectively employed in combination. When difference between the coefficients of linear expansion of the combined materials is large, the interfacial exfoliation at a connection surface may occur and the glass material may crack if thermal shock is loaded. Therefore, when materials having different coefficients of linear expansion must be unavoidably combined, a material having a medium coefficient of linear expansion between the coefficients of linear expansion of the two materials should be inserted.

Here, for the convergent parts 1*b* and the throat parts 1*a* in the cold-spray nozzles 1 shown in FIGS. 1 to 3, a member using the material excellent in heat resistance that is durable at the temperature of working gas may be employed. For example, when powder having a high melting point that requires the high temperature for working gas is used as raw material powder in the cold-spray nozzle 1 according to the present invention, it is preferable that they are constituted by a heat-resistant material such as stainless steel and "inconel". The "inconel alloy" shown herein is a nickel based super alloy excellent in high-temperature characteristics such as corrosion resistance, oxidation resistance, and creep resistance. Since the "inconel alloy" has heat resistance level of 1300° C., working gas temperature set exceeding 1000° C. causes no problem. As for the throat part 1*a* in the cold-spray nozzle 1, it is preferable to employ an abrasion-resistant material selected from cemented carbide, ceramics and the like to prevent abrasion caused by crush with raw material powder.

Although the cold-spray nozzle 1 according to the present invention having a configuration constituting of two members, the glass material 2 and the member made of material other than the glass material 3 has been described above, the present invention is not limited to such configuration. For example, the entire cold-spray nozzle 1 according to the present invention may be integrally molded by the glass material 2 depending on the operating conditions of the cold-spray device. When the entire cold-spray nozzle 1 is integrally molded by the glass material 2, the sticking of the raw material powder to the entire inner peripheral wall of the cold-spray nozzle 1 is hindered and the clogging up of the nozzle caused by such a sticking can be effectively hindered. Accordingly, the nozzle can be applied to all of particles and cold-spray condition.

Since the inner peripheral surface of the divergent part 1*c* where raw material powder easily sticks is constituted by the glass material 2 in the cold-spray nozzle 1 according to the present invention as described above, the surface different from the inner peripheral surface formed by machining metal or ceramics and the like does not catch the raw material powder at all. As the glass material 2 can be deformation worked into various shapes depending on various processing methods such as hot press molding using a metal die and the like, high molding accuracy can be achieved and is also preferable in economic view.

Embodiment of the Cold-Spray Device According to the Present Invention:

The cold-spray device according to the present invention is characterized in that the device comprises the cold-spray nozzle described above. The basic layout of the cold-spray device according to the present invention is shown in FIG. 4.

That is, the cold-spray device is the device including raw material powder supply means for supplying raw material powder, gas supply means for supplying working gas and carrier gas, and the cold-spray gun 11 for ejecting the raw material powder as supersonic flow using the working gas at a temperature equal to or below the melting point of the raw material powder. The characteristic is that the cold-spray nozzle 1 according to the present invention is used as the cold-spray gun 11.

The cold-spray device according to the present invention includes the gas supply means for supplying working gas heated at a temperature equal to or below the melting point of the raw material powder to a chamber 12 using an working gas heater 19, and the raw material powder supply means for putting the raw material powder transported through a raw material powder supply line 17 from a outlet of a powder port 11*a* arranged in the chamber 12. The acceleration and heat condition of the raw material powder drastically varies depending on the heat condition of the working gas heater 19 for the working gas. The linear velocity of the working gas in the divergent part is increased when the temperature of the gas is high and it increases the linear velocity of the raw material powder consequently. Further, when the temperature of the raw material powder is elevated, the plastic deformation at crush is made easy and it improves both the deposition ratio to the base material 20 and the film characteristics. However, phenomenon of the raw material powder sticking in the divergent part 1*c* in the cold-spray nozzle 1 and the nozzle clogging up tend to occur under the cold-spray operation carried out at high temperature under high pressure empirically.

However, by employing the cold-spray nozzle 1 as described above in the cold-spray device according to the present invention, the raw material powder does not stick to the inner peripheral surface of the divergent part 1*c* in the cold-spray nozzle 1 even in the long time cold-spray operation at high temperature under high pressure.

That is, in the case using the cold-spray device according to the present invention, the nozzle does not clog up even in the long time cold-spray operation at high temperature under high pressure. Accordingly, as a temperature of the raw material powder is elevated to increase the crush speed of the raw material powder with the base material 20, the deformation amount of the raw material powder crush with the surface of the base material 20 can be increased. Therefore, in the cold-spray device according to the present invention, raw material powder having a high melting point such as nickel powder, titanium powder and the like to which a conventional cold-spray device can hardly perform film formation. Further, since the nozzle does not easily clog up, the cold-spray operation for a long time is made possible and it drastically improves efficiencies in both film formation and the device operation.

The present invention will be explained below in detail with referring to Examples.

Example 1

Cold-Spray Nozzle and Cold-Spray Device

The cold-spray nozzle used in Example 1 is the cold-spray nozzle shown in FIG. 1. The entire divergent part 1*c* was constituted by the glass material 2 (borosilicate glass). That is, the inner peripheral surface of the divergent part after the throat part 1*a* toward the spout of working gas 1*e* side was constituted by borosilicate glass. Then detail will be explained with reference to FIG. 1.

A space surrounded by the inner peripheral surface in the convergent part 1*b* was substantially a conical shape having the inner diameter of 20 mm at an inlet end, the inner diameter of 2 mm at the throat part 1*a*, and the length of 150 mm. Then, the inlet end of the convergent part 1*b* was arranged to face the cylindrical powder port 11*a* (inner diameter of 20 mm-phi, length of 100 mm) provided in the chamber 12 as a preheat region. The distance from the outlet end of the powder port 11*a* to the throat part 1*a* was 200 mm. A region surrounded by the inner peripheral surface in the divergent part 1*c* was substantially conical shape with length 200 mm from the throat part 1*a* to the spout 1*e* having the inner diameter of 6 mm.

[Film Formation by Cold-Spray Device]

In Example 1, the cold-spray nozzle described above was equipped in the cold-spray device having the structure shown in FIG. 4 and the cold-spray operation was carried out for 300 minutes. In the cold-spray operation, nitrogen gas was used as working gas, "inconel 625" powder that more easily causes the clogging up of the nozzle than copper powder was used as the raw material powder, the temperature of the working gas was 800° C., the powder supply speed was 200 g/minute, and the chamber gas pressure was 3 MPa.

As a result of the above-described test, the cold-spray operation for 300 minutes was performed without turbulence in the jet flow of the "inconel 625" powder and the clogging up of the cold-spray nozzle 1. In the investigation of the inner peripheral surface of the cold-spray nozzle after finishing the cold-spray operation, the sticking of the "inconel 625" powder to any of the divergent part 1*c*, the throat part 1*a*, and the convergent part 1*b* was not detected. The film formation efficiency of the "inconel 625" powder in Example 1 was satisfactory 70%.

Example 2

Example 2 will be described below. However, Example 2 was basically the same as the Example 1 with regard to each item. Therefore, the overlapping explanation will be omitted and only the difference from the Example 1 will be described.

[Cold-Spray Nozzle and Cold-Spray Device]

The cold-spray nozzle used in Example 2 is as shown in FIG. 3. The divergent part 1*c* is provided with an inner peripheral surface constituted by the glass material 2 (borosilicate glass) after the position of 50 mm from the throat part 1*a* toward the outlet for the working gas side of the divergent part to the spout for the working gas 1*e* in the divergent part. The outer peripheral portion of the divergent part 1*c* was constituted by silicon nitride ceramics. The layout of the cold-spray device employed was the same as in the Example 1 of which layout is schematically shown in FIG. 4.

[Film Formation by Cold-Spray Device]

In Example 2, a film of "inconel 625" was formed as same in the Example 1. As a result of the above-described test, the cold-spray operation for 300 minutes was performed without turbulence in the jet flow of the "inconel 625" powder and the clogging up of the cold-spray nozzle 1. In the investigation of the inner peripheral surface of the cold-spray nozzle after finishing the cold-spray operation, the sticking of the "inconel 625" powder to any of the divergent part 1*c*, the throat part 1*a*, and the convergent part 1*b* was not detected. The film formation efficiency of the "inconel 625" powder in Example 2 was satisfactory 95%.

Example 3

In Example 3, the same device as in Example 1 was used. The glass material part was constituted by quartz glass, and the raw material powder was changed to the "stainless steel (316L)" powder that more easily causes the clogging up of the nozzle than copper powder. The overlapping explanation will be omitted, and only the clogging up state of the cold-spray nozzle 1 will be described.

As a result of the above-described test, the cold-spray operation for 300 minutes was performed without turbulence in the jet flow of the "stainless steel (316L)" powder and the clogging up of the cold-spray nozzle 1. In the investigation of the inner peripheral surface of the cold-spray nozzle after finishing the cold-spray operation, the sticking of the "stainless steel (316L)" powder to any of the divergent part 1*c*, the throat part 1*a*, and the convergent part 1*b* was not detected. The film formation efficiency of the "stainless steel (316L)" powder was satisfactory 90%.

Example 4

In Example 4, the same device as in Example 2 was used. The glass material part was constituted by quartz glass, and the "stainless steel (316L)" powder was used as the raw material powder as in Example 3. So, the overlapping explanation will be omitted, and only the clogging up state of the cold-spray nozzle 1 will be explained.

As a result of the above-described test, the cold-spray operation for 300 minutes was performed without turbulence in the jet flow of the "stainless steel (316L)" powder and the clogging up of the cold-spray nozzle 1. In the investigation of the inner peripheral surface of the cold-spray nozzle after finishing the cold-spray operation, the sticking of the "stainless steel (316L)" powder to any of the divergent part 1*c*, the throat part 1*a*, and the convergent part 1*b* was not detected. The film formation efficiency of the "stainless steel (316L)" powder was satisfactory 90%.

COMPARATIVE EXAMPLES

Comparative Example 1

In Comparative Example 1, as the same raw material powder as in Examples 1 and 2 was used, Comparative Example 1 was carried out for comparison with mainly Examples 1 and 2.

In Comparative Example 1, the shape of the cold-spray nozzle 1 and the operating conditions of the cold-spray device were the same as in Examples except that the entire divergent part 1*c* including the inner peripheral surface of the cold-spray nozzle 1 was made of silicon nitride ceramics. In the test where the cold-spray nozzle for Comparative Example 1 was used, sticking of the "inconel 625" powder was not detected at 30 minutes operation of the cold-spray device. That is, level of the advantageous effect disclosed in Patent Document 1 was confirmed. However, as the sticking of a little amount of the "inconel 625" powder to the cold-spray nozzle was detected at 120 minutes operation of the cold-spray, the test was stopped.

Comparative Example 2

In Comparative example 2, as the same raw material powder as in Examples 3 and 4 was used, Comparative Example 2 was carried out for comparison with mainly Examples 3 and 4.

In Comparative Example 2, the shape of the cold-spray test nozzle 1 and the operating conditions of the cold-spray device were the same as in Examples except that the entire divergent part 1*c* including the inner peripheral surface of the cold-spray nozzle 1 was made of silicon nitride ceramics. In the test where the cold-spray nozzle for Comparative Example 2 was used, sticking of the "stainless steel (316L)" powder was not detected at 30 minutes operation of the cold-spray device. That is, level of the advantageous effect disclosed in Patent Document 1 was confirmed. However, as the sticking of a little amount of the "stainless steel (316L)" powder to the cold-spray nozzle was detected at 120 minutes operation of the cold-spray, the test was stopped.

INDUSTRIAL APPLICABILITY

As the sticking of the raw material powder to the inner peripheral surface of the divergent part followed by clogging up of the cold-spray nozzle can be drastically hindered by using the cold-spray nozzle according to the present invention, a long time cold-spray operation can be achieved. Then, the long time cold-spray operation improves film formation efficiency and results drastic reduction of the production cost in the cold-spray method. By employing the cold-spray nozzle according to the present invention, formation of a thick film that requires a long time operation of cold-spray device is made easy.

The cold-spray device according to the present invention enables operation using a working gas at high temperature under high pressure without causing clogging up of the nozzle. Consequently, various types of powder that has never been applicable can be used as raw material powder for forming a cold-spray film.

The invention claimed is:

1. A convergent-divergent type cold-spray nozzle comprising:

a convergent part;

a throat part; and a divergent part sequentially arranged in this order for constituting a working gas flow path along a working gas flow direction from an inlet side to an outlet side, wherein an inner peripheral surface of the divergent part has a conical shape and at least the inner peripheral surface from a position within 50 mm from the throat part to a spout from where the working gas ejects is constituted by a glass material.

2. The cold-spray nozzle according to claim 1, wherein, the glass material is quartz glass or borosilicate glass.

3. A cold-spray device comprising the cold-spray nozzle according to claim 1.

4. A cold-spray device comprising the cold-spray nozzle according to claim 2.

* * * * *